US011109700B2

(12) United States Patent
Henry et al.

(10) Patent No.: US 11,109,700 B2
(45) Date of Patent: Sep. 7, 2021

(54) UTENSIL HAVING SELF-STORAGE HANDLE

(71) Applicant: Skip Hop, Inc., New York, NY (US)

(72) Inventors: Lou Henry, Scarsdale, NY (US); Chris Mellen, Yonkers, NY (US)

(73) Assignee: Skip Hop, Inc., New York, NY (US)

( * ) Notice: Subject to any disclaimer, the term of this patent is extended or adjusted under 35 U.S.C. 154(b) by 55 days.

(21) Appl. No.: 16/530,518

(22) Filed: Aug. 2, 2019

(65) Prior Publication Data

US 2021/0030177 A1 Feb. 4, 2021

(51) Int. Cl.
*A47G 21/04* (2006.01)
*A47G 21/02* (2006.01)
*A47G 21/00* (2006.01)

(52) U.S. Cl.
CPC ..... *A47G 21/04* (2013.01); *A47G 21/02* (2013.01); *A47G 21/023* (2013.01); *A47G 2021/002* (2013.01)

(58) Field of Classification Search
CPC ..... A47G 21/02; A47G 21/023; A47G 21/04; A47G 2021/002
USPC ..... 30/125, 142–150, 160, 161, 322–328, 30/541; 16/111.1; D7/643
See application file for complete search history.

(56) References Cited

U.S. PATENT DOCUMENTS 721,247 A * 2/1903 Smart ..... A47G 21/02 30/150
2,459,733 A * 1/1949 Macy ..... A45D 40/02 132/316
2,820,291 A * 1/1958 Philippar ..... B26B 1/04 30/153
4,204,294 A * 5/1980 Halverson ..... A46B 5/0033 7/168
4,615,120 A * 10/1986 Newman ..... A47G 21/02 30/324
5,188,234 A * 2/1993 Fukuda ..... A45F 3/46 206/541
5,197,623 A * 3/1993 Wang ..... A47G 21/06 206/542
5,261,560 A * 11/1993 Wang ..... A47G 21/06 30/150
D347,975 S * 6/1994 Zeller ..... D7/642
5,419,049 A * 5/1995 MacArthur-Onslow ..... A47G 21/02 30/322
5,590,472 A * 1/1997 Yaakov ..... A47G 21/02 30/327
5,647,129 A * 7/1997 Stamper ..... B26B 1/042 30/161

(Continued)

FOREIGN PATENT DOCUMENTS

EP 3019054 B1 * 8/2017 ..... A47G 21/02

*Primary Examiner* — Jason Daniel Prone
(74) *Attorney, Agent, or Firm* — Greenberg Traurig, LLP

(57) ABSTRACT

A utensil may include a utensil body and a handle comprising a first portion and a second portion, the first portion hingedly coupled to the utensil body. The first portion is movably coupled to the second portion to enable the handle to be configured into an open state and a closed state. The open state permits the utensil body to hingedly move with respect to the first portion between a first position in which the utensil body is operatively usable by a user. A second position in which the utensil body is stored within the handle, and the closed state includes the handle enclosing the utensil body.

20 Claims, 11 Drawing Sheets

(56) References Cited

U.S. PATENT DOCUMENTS 5,722,168 A * 3/1998 Huang ..... B23D 51/01 30/160
5,735,050 A * 4/1998 Hsieh ..... A47G 21/04 30/322
5,916,277 A * 6/1999 Dallas ..... B26B 11/008 30/143
5,940,974 A * 8/1999 Lee ..... A47G 21/02 30/322
5,992,667 A * 11/1999 Huang ..... A47G 21/02 30/322
6,698,065 B2 * 3/2004 Lauer ..... A47G 21/02 16/110.1
6,751,873 B2 * 6/2004 Mattson ..... A47G 21/02 30/322
7,093,363 B1 * 8/2006 Kuo ..... B26B 21/40 30/541
7,347,128 B2 * 3/2008 Rivera ..... B25B 15/001 30/161
D575,593 S * 8/2008 Svartstrom ..... D7/644
7,614,325 B2 * 11/2009 Huang ..... B25G 1/00 30/323
9,247,803 B2 * 2/2016 Lim ..... A45D 34/042
9,468,321 B2 * 10/2016 Miksovsky ..... A47G 21/04
9,560,925 B2 * 2/2017 Harris ..... A47G 21/04
9,771,188 B2 * 9/2017 Glassman ..... A47G 21/02
2002/0073553 A1 * 6/2002 Yang ..... A47G 21/06 30/150
2004/0134074 A1 * 7/2004 Lin ..... B26B 11/00 30/144
2009/0144991 A1 * 6/2009 Synnestvedt ..... A47G 21/02 30/324
2009/0178284 A1 * 7/2009 Lane ..... A47G 21/02 30/340
2019/0335931 A1 * 11/2019 Ribi ..... A47G 21/04
2020/0022515 A1 * 1/2020 Park ..... A47G 21/04

* cited by examiner

UTENSIL HAVING SELF-STORAGE HANDLE

FIELD OF THE DISCLOSURE

The instant disclosure relates to a utensil having a self-storage handle, such as a spoon or fork in which the utensil body may be stored in the handle of the utensil.

BACKGROUND

A utensil, such as a fork or spoon, may be used by a child or by a parent to feed the child. The utensil may be stored in a protective casing or other enclosure to transport the utensil while minimizing the environmental germs and other harmful substances that come into contact with the utensil during storage or transportation. Such protective casings are generally separate containers, such as clamshell-style containers, from which the utensil is completely removed for use.

SUMMARY

An example of a utensil may include a utensil body and a handle, the handle including a first portion and a second portion, the first portion hingedly coupled to the utensil body, wherein the first portion is movably coupled to the second portion to enable the handle to be selectively configured in an open state or a closed state, wherein the open state permits the utensil body to hingedly move with respect to the first portion between a first position, in which the utensil body is operatively usable by a user, and a second position, in which the utensil body is stored within the handle, and the closed state comprises the handle enclosing the utensil body.

In some embodiments, the handle may include a distal end portion and a proximal end portion, wherein the first portion is hingedly coupled to the utensil body at the distal end portion, and the first portion is hingedly coupled to the second portion at the proximal end portion.

In some embodiments, the utensil may further include a latch configured to secure the handle in the closed state.

In some embodiments, the latch may include a protrusion on one of the utensil body and the handle, and a receiving formation, on the other of the utensil body and the handle, configured to releasably receive the protrusion.

In some embodiments, the receiving formation may be a first receiving formation configured to releasably receive the protrusion to secure the handle in the closed state with the utensil body in the first position, wherein the latch further includes a second receiving formation configured to releasably receive the protrusion to secure the handle in the closed state with the utensil body in the second position.

In some embodiments, the first and second receiving formations may be defined in opposed sides of the utensil body.

In some embodiments, the protrusion may be provided on the second portion.

In some embodiments, the utensil may further include a latch release, coupled to the latch and disposed on an exterior of the utensil, configured to release the latch responsive to user actuation.

In some embodiments, the handle may further include a distal end, wherein the latch release is disposed proximate the distal end.

In some embodiments, one of the utensil body or the first portion of the handle may include a lateral protrusion, and the other of the utensil body or the first portion of the handle may include a receiving formation that receives the lateral protrusion to hingedly couple the utensil body with the first portion of the handle.

In some embodiments, the utensil body may include a neck having a proximal end and a distal end, the lateral protrusion, protruding from the proximal end of the neck, and a working element disposed at the distal end of the neck, wherein the neck, the lateral protrusion, and the working element comprise a monolithic body of material.

In some embodiments, the utensil body may be configured to rotate with respect to the first portion of the handle about a first hinge axis and the second portion of the handle may be configured to rotate with respect to the first portion of the handle about a second hinge axis, wherein the first hinge axis is substantially parallel with the second hinge axis.

In some embodiments, the utensil body may be configured to rotate with respect to the first portion of the handle about a first hinge axis, the first hinge axis substantially perpendicular to a direction of extension of the utensil body from the handle in the first position.

In some embodiments, the utensil body may be or may include a spoon or a fork.

In some embodiments, the first portion may be hingedly coupled with the second portion, wherein one of the first portion or the second portion of the handle includes a lateral protrusion, and the other of the first portion or the second portion includes a receiving formation that receives the lateral protrusion to hingedly couple the first portion with the second portion.

In some embodiments, the first portion and the second portion may collectively define a cavity configured to receive the utensil body in the second position.

In some embodiments, the first portion and the second portion may further define a distal opening of the cavity, wherein a proximal end portion of the utensil body substantially covers the distal opening.

DETAILED DESCRIPTION

A utensil according to the present disclosure may include a utensil body and a handle that may also function as a storage container for the utensil body, such that the utensil may be transported with reduced exposure of the utensil body to environmental germs. For example, in some embodiments, the utensil body may be hingedly coupled to the handle, and the handle may be movable between an open position, configuration, or state in which the utensil body may be moved into and out of the handle, and a closed position, configuration, or state in which the handle is closed with the utensil body stored inside of the handle or with the utensil body extended from the handle. The utensil body may be movable between a first position, configuration, or state in which the utensil body extends out of the handle for operative use, and a second position, configuration, or state in which the utensil body is stored inside of the handle. The utensil body may be or may include a spoon, fork, or other utensil.

The instant disclosure refers to an embodiment in which the utensil body includes a spoon, but such disclosure is by way of example only. A utensil according to the present disclosure may be configured for use by a child, in some embodiments.

Figure 1:
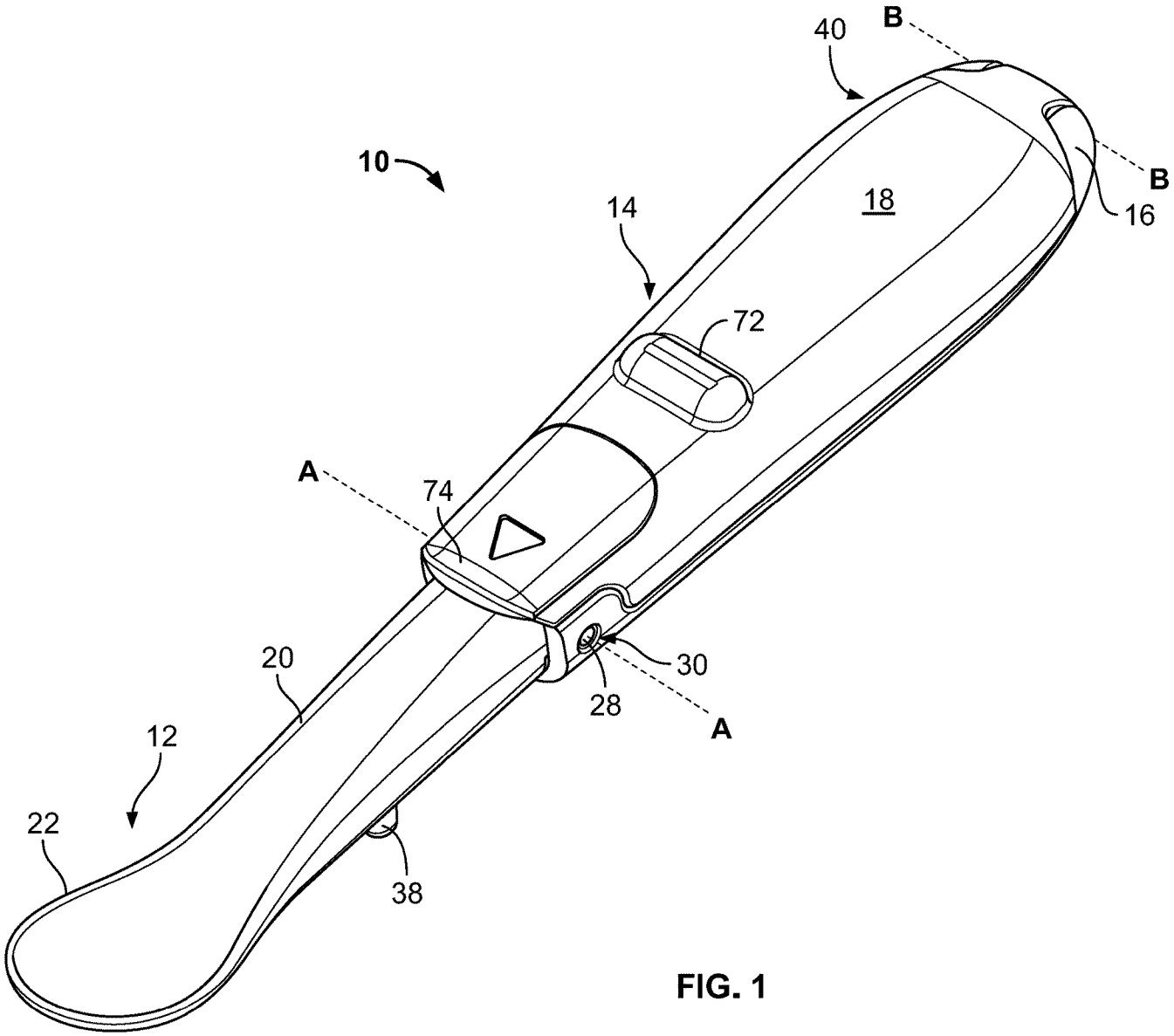
FIG. 1 is a top perspective view of an example embodiment of a spoon having integrated self-storage, with the spoon body in an operative state.
Figure 2:
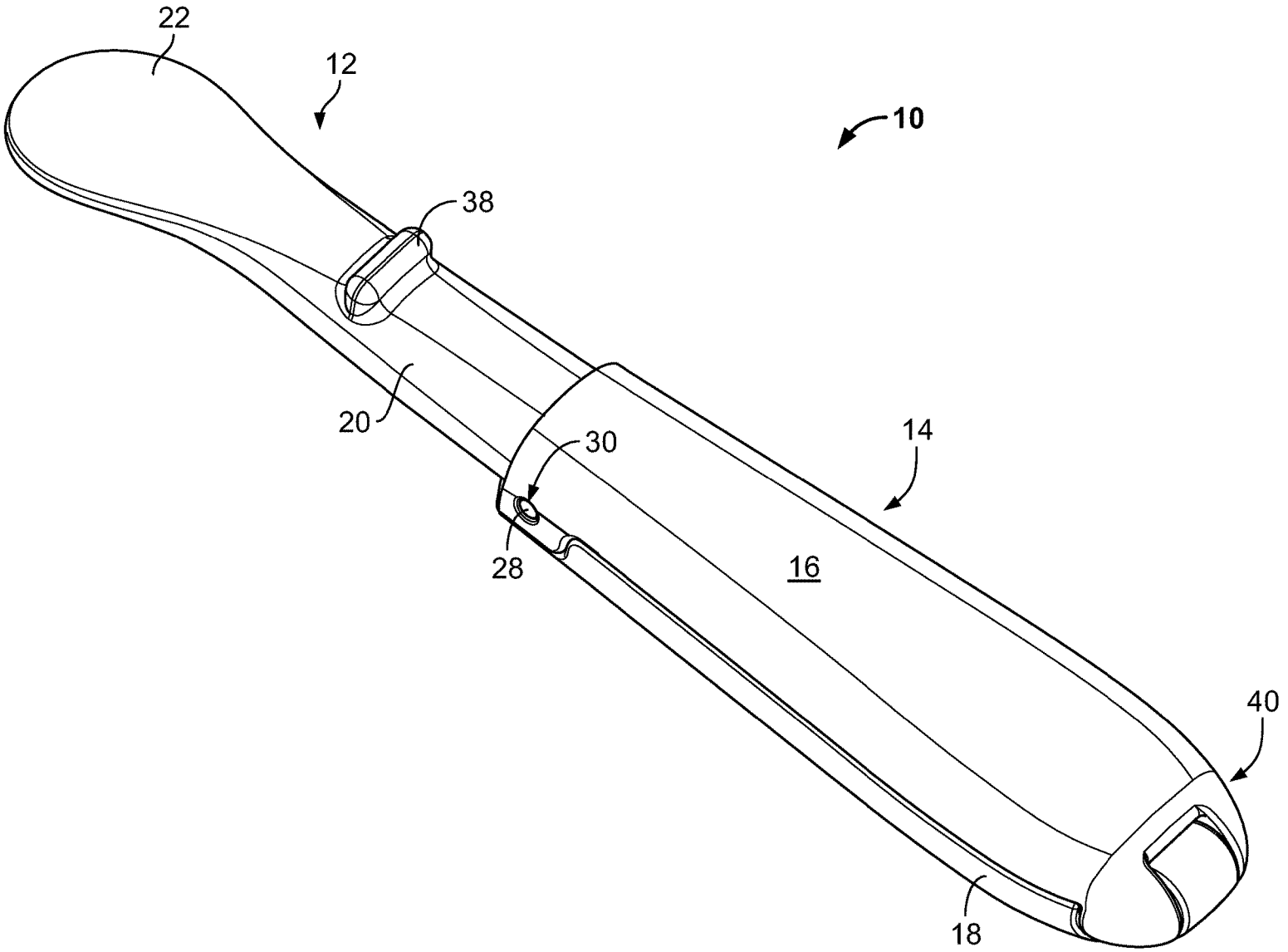
FIG. 2 is a bottom perspective view of the example embodiment of a spoon having integrated self-storage of FIG. 1, with the spoon body in the operative state.

Referring to the drawings, wherein like numerals refer to the same or similar features in the various views, FIGS. 1 and 2 are perspective views of an example utensil 10 having a utensil body 12 and a handle 14. The utensil body 12 may be hingedly or otherwise movably coupled with the handle 14. As will be described in further detail below, the utensil body 12 may be movable between a first position, illustrated in FIGS. 1 and 2, in which the utensil body 12 is operatively usable by a user, and a second position, illustrated in FIG. 4, in which the utensil body 12 is stored within the handle.

Figure 3:
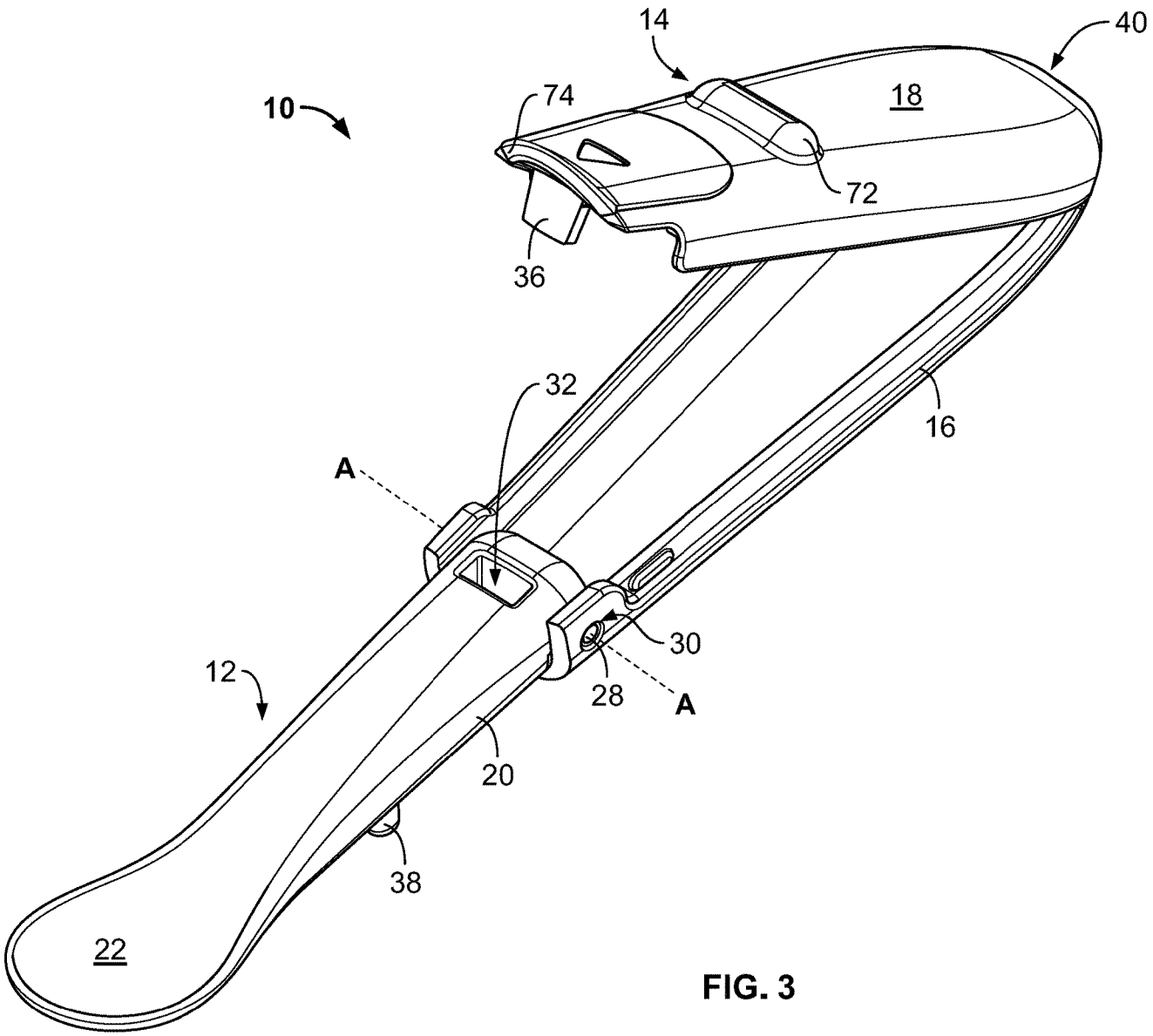
FIG. 3 is a top perspective view of the example embodiment of a spoon having integrated self-storage of FIG. 1, with the handle in a partially-open state.

FIG. 3 is a perspective view of the utensil 10, illustrating the handle 14 in a partially-open state. The handle 14 may include a first, lower portion 16 and a second, upper portion 18, in some embodiments. The first portion 16 may be movably coupled to the second portion 18. In some embodiments, the first portion 16 may be hingedly coupled with the second portion 18. The first and second portions 16, 18 may be movable with respect to one another between a closed state, illustrated in FIGS. 1 and 2, and an open state, illustrated in FIG. 3. Specifically, FIG. 3 illustrates a partially-open state with a hinged coupling of the first and second portions 16, 18. In the embodiment illustrated in FIG. 3, the first and second portions 16, 18 may be further moved into a completely open state in which the first portion 16 hinges approximately one hundred and eighty degrees with respect to the second portion 18 (e.g., one hundred eighty degrees from the configuration illustrated in FIGS. 1 and 2, where FIG. 3 illustrates approximately forty-five degrees of rotation). In other embodiments, the first and second portions 16, 18 may be entirely removable from one another, or may be hingedly movable over a smaller or larger range of motion than one hundred eighty degrees. Still further, in some embodiments, the first portion 16 may be slidably movable with respect to the second portion 18, in addition to or instead of being hingedly movable with respect to the second portion 18.

Figure 4:
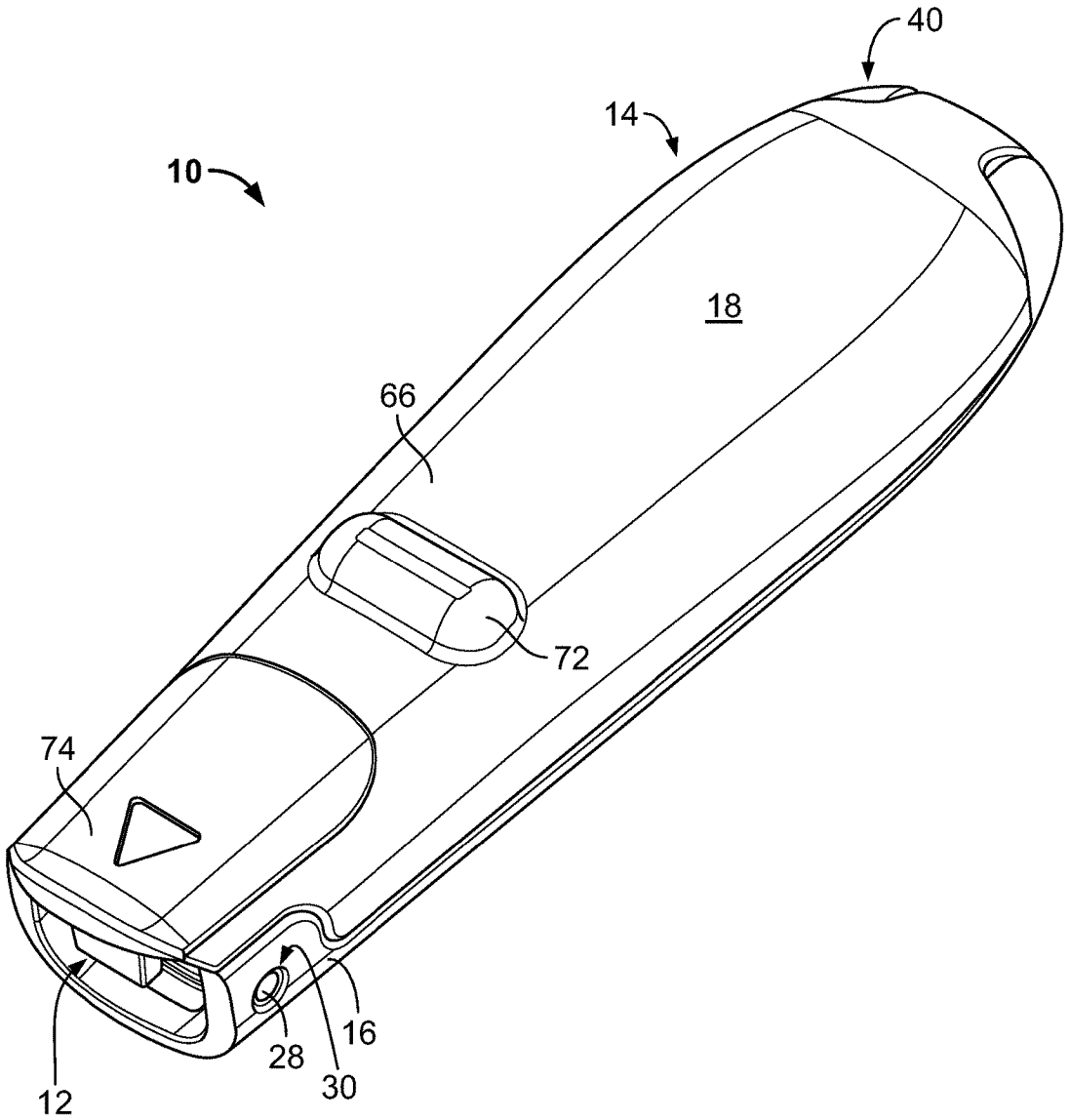
FIG. 4 is a top perspective view of the example embodiment of a spoon having integrated self-storage of FIG. 1, with the handle in a closed state and the spoon body in a stored state.

The utensil body 12 may be hingedly or otherwise rotatably coupled with the first portion 16, in an embodiment. The utensil body 12 may therefore be movable with respect to the handle 14 between the first and second positions of the utensil body 12. FIG. 4 is a perspective view of the utensil 10, with the handle 14 in a closed position and the utensil body 12 in its second position, in which the utensil body 12 is stored within the handle. As shown in FIG. 4, in the second position, the utensil body 12 may be enclosed within the handle 14.

The utensil body 12 may be hingedly coupled with the first portion 16 along a first hinge axis A, and may therefore be rotatable with respect to the first portion 16 about the first hinge axis A. The second portion 18 may be hingedly coupled with the first portion 16 along a second hinge axis B, and may therefore be rotatable with respect to the first portion 16 about the second hinge axis B. The first hinge axis A may be substantially parallel with the second hinge axis B, in some embodiments. Both the first and second hinge axes A, B may be substantially perpendicular to the length of the utensil body 12, in an embodiment. Furthermore, both the first and second hinge axes A, B may be substantially perpendicular to a direction of extension of the utensil body 12 from the handle 14 in the first, operative position of the utensil body 12.

Figure 5:
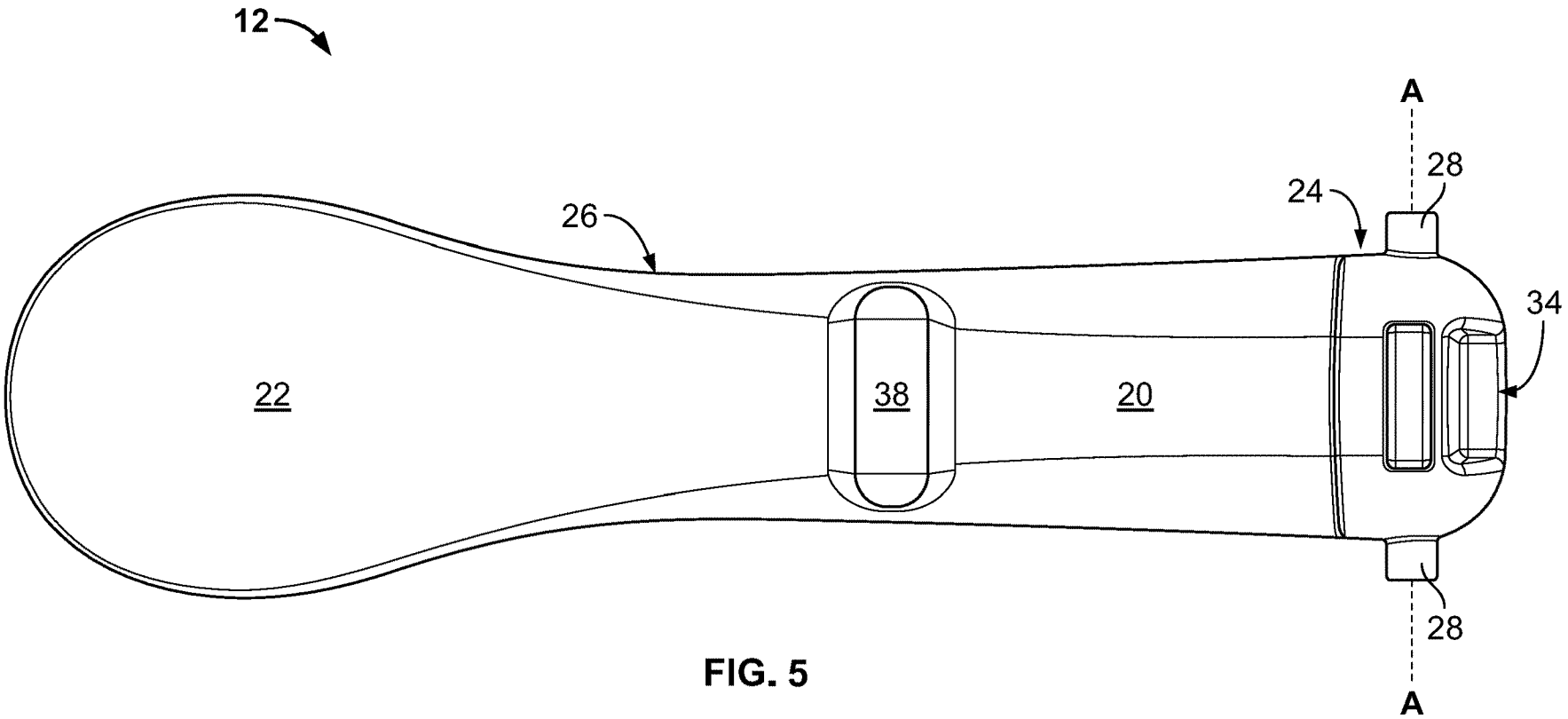
FIG. 5 is a bottom view of a spoon body of the example spoon having integrated self-storage of FIG. 1.

FIG. 5 is a bottom view of the utensil body 12. Referring to FIGS. 1-3 and 5, the utensil body 12 may include a neck portion 20 and a working element 22. The neck portion 20 may have a length extending from a proximal end portion 24 to a distal end portion 26 and a width that is perpendicular to its length. The working element 22 may be distal of the neck portion 20.

As used herein, the terms "proximal" and "distal" refer to the end, end portion, direction, etc. of the utensil (or component thereof) as the utensil or component is oriented during operative use, with the utensil body 12 in the first position.

The proximal end portion 24 of the neck portion 20 may include one or more lateral protrusions 28 which may interface with respective receiving formations 30 defined by the first portion 16 of the handle 14 to hingedly couple the utensil body 12 with the first portion 16 of the handle 14. The one or more lateral protrusions 28 may define the first hinge axis A. The one or more lateral protrusions 28 may have a size and shape appropriate for enabling rotation of the utensil body 12 with respect to the first portion 16. In some embodiments, the one or more lateral protrusions 28 may be substantially cylindrical and may be radially symmetric about the first hinge axis A. The receiving formations 30 may have a size and shape appropriate to receive the lateral protrusions 28 and permit rotation of the lateral protrusions 28 within the receiving formations 30. In some embodiments, the receiving formations 30 may be substantially circular apertures. In some embodiments, the receiving formations 30 may extend through the entire thickness of the first portion 16, as illustrated. In other embodiments, the receiving formations 30 may terminate within the thickness of the first portion 16.

In some embodiments, instead of one or more of the lateral protrusions 28 being provided on the utensil body 12 and one or more of the receiving formations 30 being defined in the handle 14, one or more lateral protrusions may be provided on the handle 14, and one or more corresponding receiving formations may be defined in the utensil body 12 for movably coupling the utensil body 12 with the handle 14.

The proximal end portion 24 of the neck portion 20 may define two receiving formations 32, 34 that may couple with a protrusion 36 of the handle 14 for securing the utensil body 12 in the first position and the second position, with the handle 14 in the closed configuration. A first receiving formation 32 (see FIG. 3) may be defined in an upper surface of the neck portion 20 and may receive the protrusion 36 of the handle 14 to secure the utensil body 12 in the first position. A second receiving formation 34 (see FIG. 5) may be defined in a lower surface of the neck portion 20 and may receive the protrusion 36 of the handle 14 to secure the utensil body 12 in the second position. Accordingly, the receiving formations 32, 34 may be defined in opposed sides of the utensil body 12.

The utensil body 12 may further include a base 38, disposed on the lower side of the neck portion 20. The base 38 may protrude from the lower side of the neck portion 20 to a sufficient extent that, when the utensil 10 is placed on a flat surface with the lower surface of the handle 14 resting on the flat surface, the base 38 prevents the working element 22 of the utensil body 12 from contacting the flat surface, thereby reducing movement of germs and bacteria between the flat surface and the working element 22. The base 38 may extend across the width of the neck portion 20, in an embodiment.

In some embodiments, the utensil body 12 (including the working element 22, neck portion 20, lateral protrusions 28, and base 38) may comprise a single, monolithic body of material. The material may be a thermoplastic polymer, such as polypropylene, or another molded plastic, in some embodiments.

Figure 6:
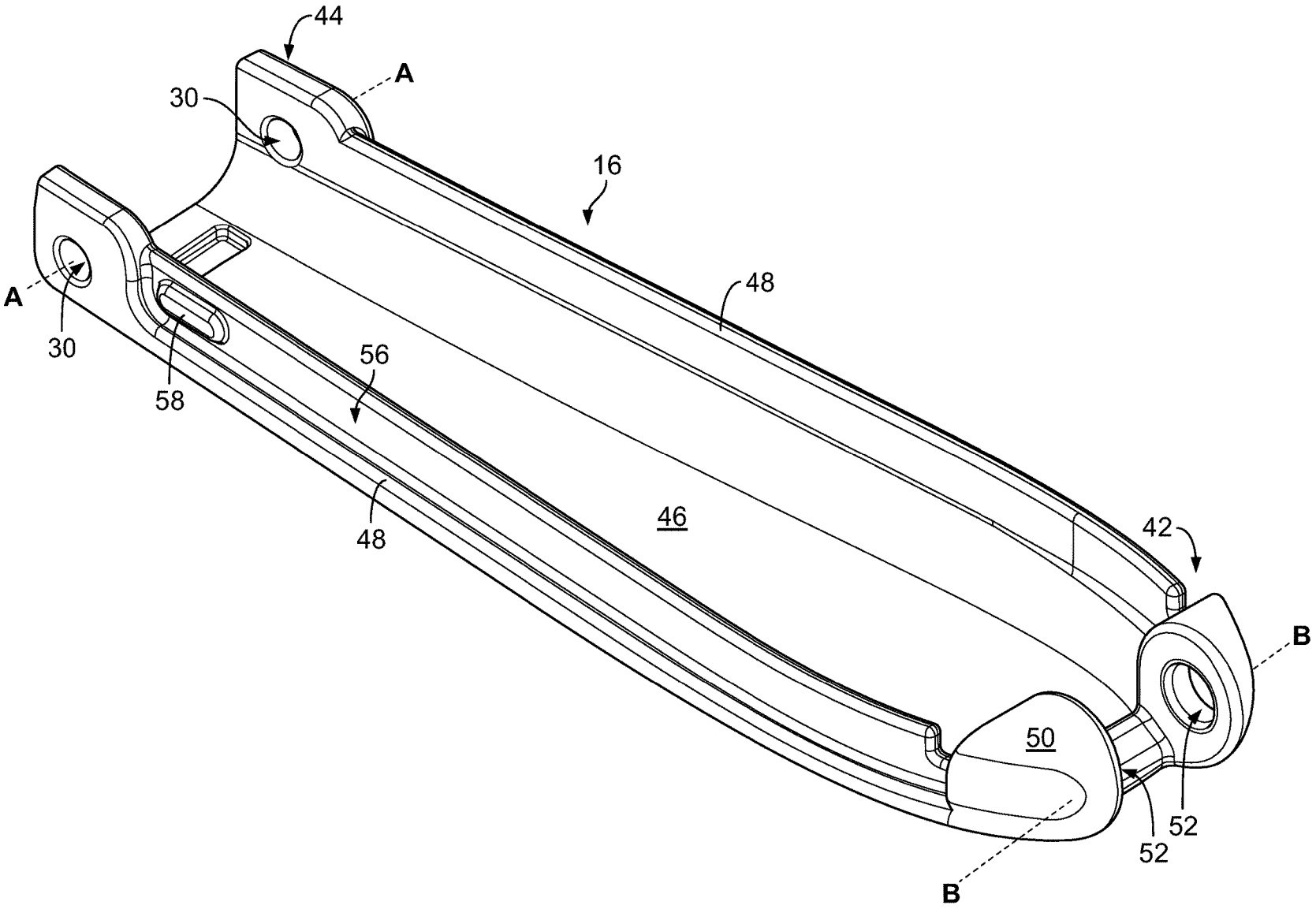
FIG. 6 is a perspective view of a first handle portion of the example spoon having integrated self-storage of FIG. 1.
Figure 7:
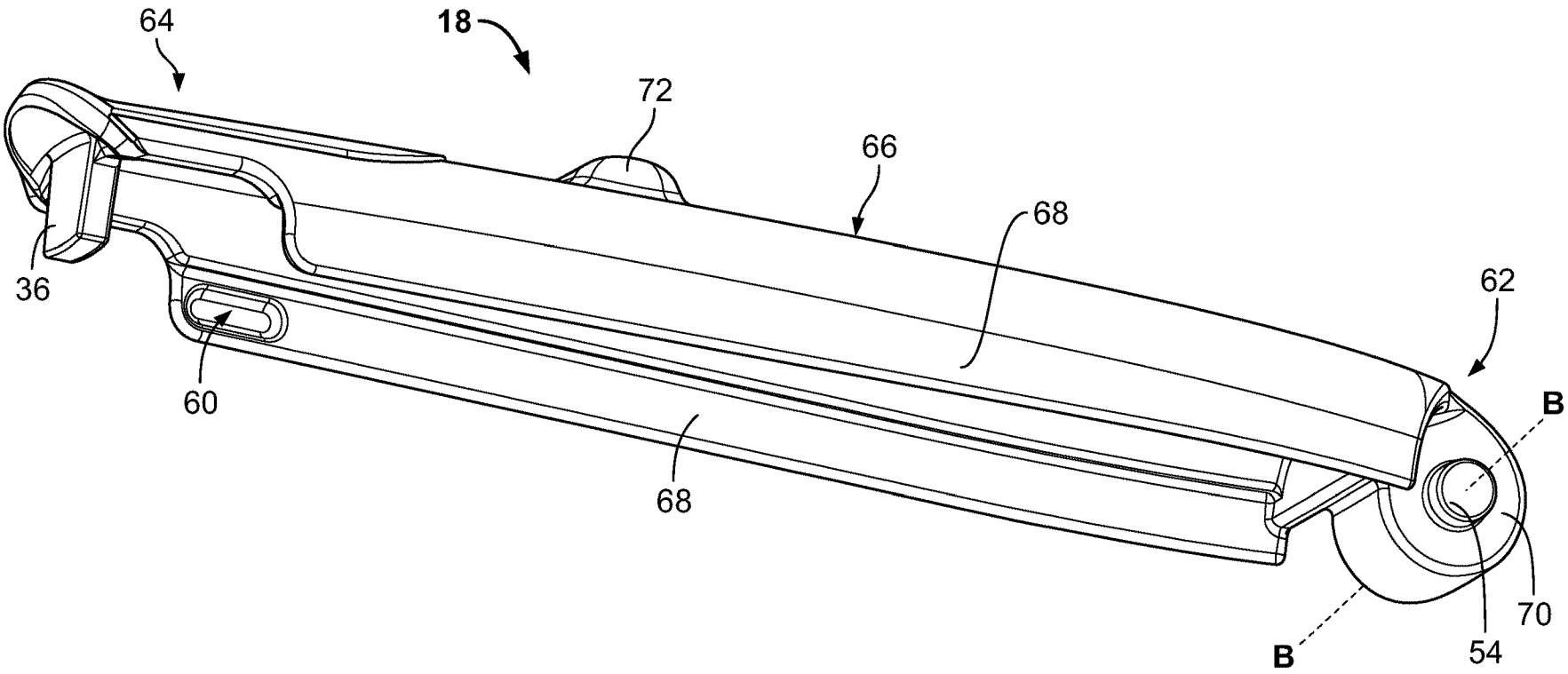
FIG. 7 is a perspective view of a second handle portion of the example spoon having integrated self-storage of FIG. 1.
Figure 8:
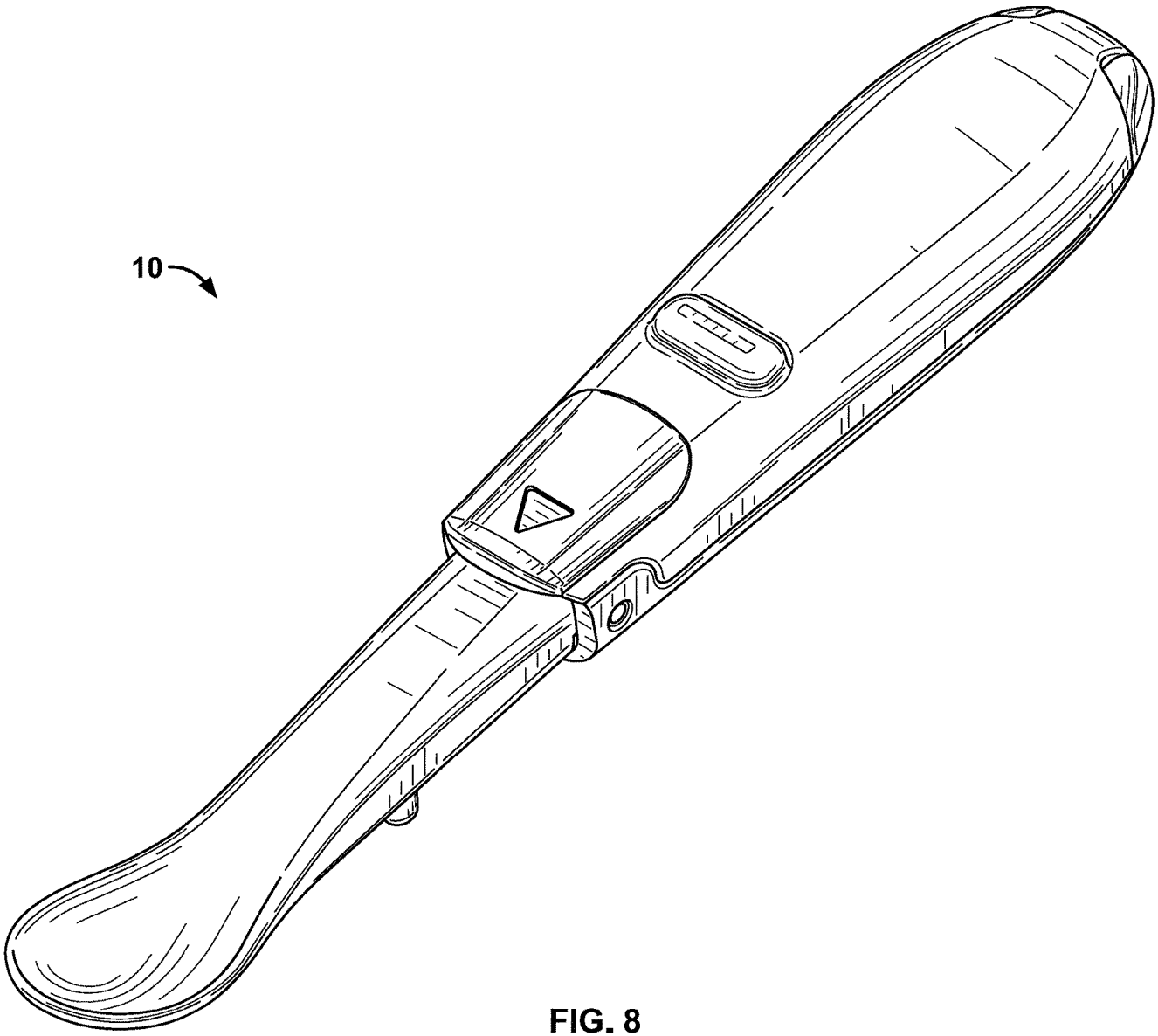
FIG. 8 is a perspective view of an example embodiment of a spoon having integrated self-storage.
Figure 9:
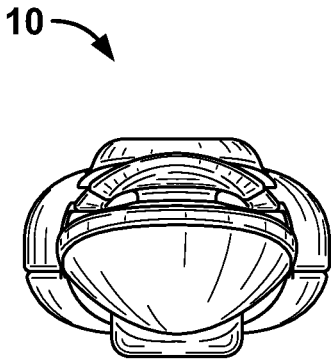
FIG. 9 is a front elevational view of the spoon of FIG. 8.
Figure 10:
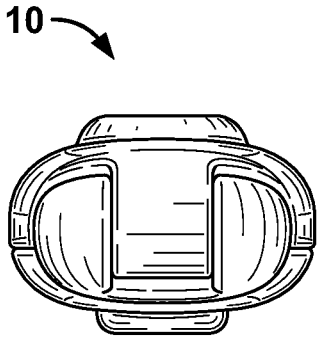
FIG. 10 is a rear elevational view of the spoon of FIG. 8.
Figure 11:
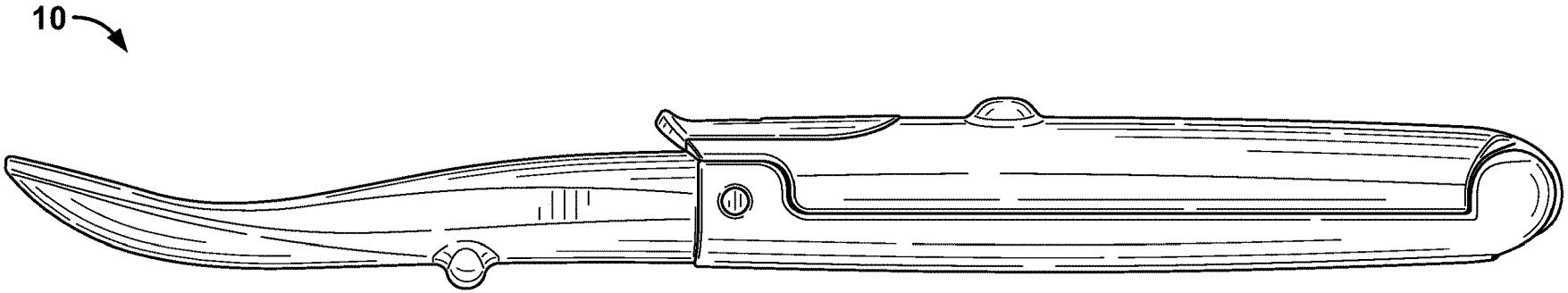
FIG. 11 is a left-side elevational view of the spoon of FIG. 8.
Figure 12:
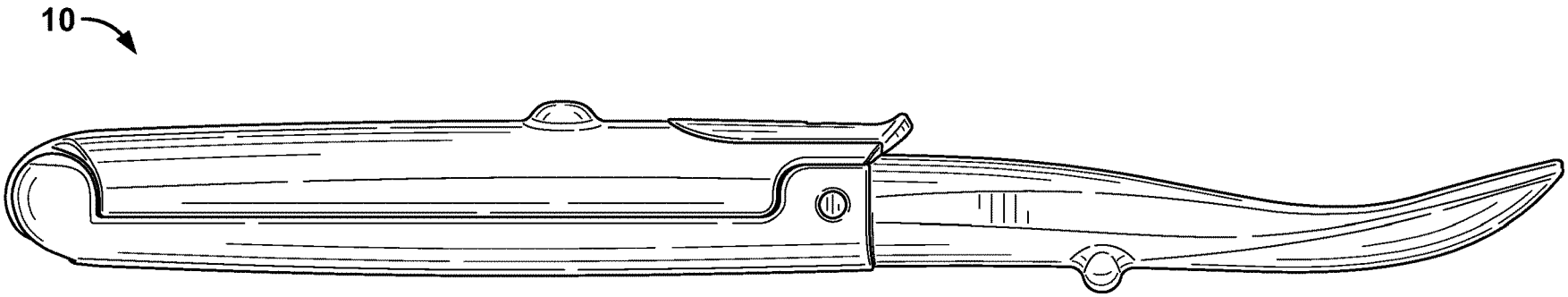
FIG. 12 is a right-side elevational view of the spoon of FIG. 8.
Figure 13:
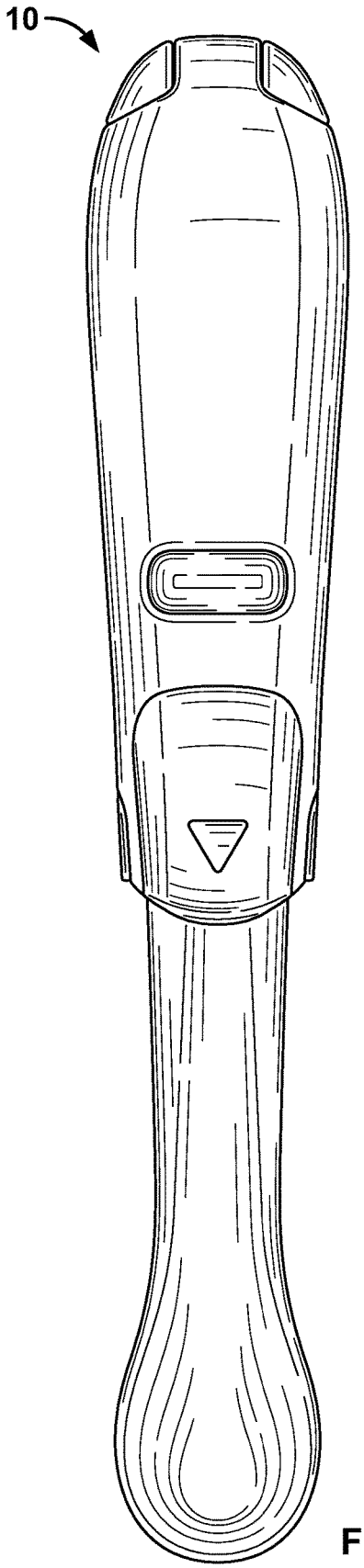
FIG. 13 is a top elevational view of the spoon of FIG. 8.
Figure 14:
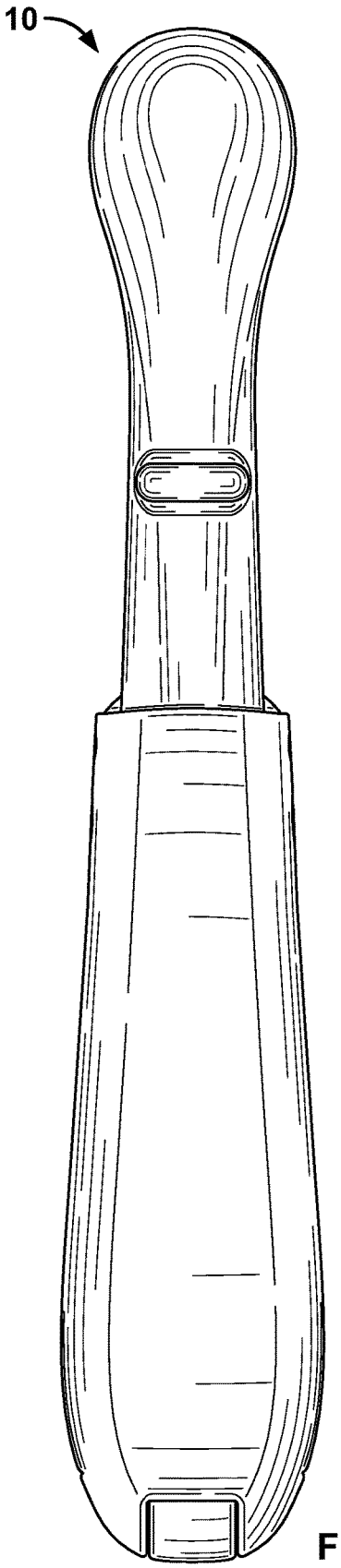
FIG. 14 is a bottom elevational view of the spoon of FIG. 8.

The working element 22 of the utensil body 12 may include a bowl forming a spoon, a plurality of tines forming a fork, and/or some other utensil implement, in some embodiments. FIG. 6 is a perspective view of the first handle portion 16, and FIG. 7 is a perspective view of the second handle portion 18. The first and second portions 16, 18 may collectively define a shell which may function both as a handle and as a storage implement for the utensil body 12. The first and second portions 16, 18 may be hingedly coupled to one another at the proximal end portion 40 of the handle 14, in some embodiments, enabling the first and second portions 16, 18 to hingedly move with respect to each other between an open position, in which the utensil body 12 may be hingedly moved between its first position and its second position, and a closed position in which the utensil body 12 is stored within the handle 14 or the utensil body 12 extends from the handle 14 for operative use. Accordingly, the first portion 16 may be hingedly coupled to the utensil body 12, and the first portion 16 may be movably coupled to the second portion 18 to enable the handle 14 to be configured into an open state and a closed state, wherein the open state permits the utensil body 12 to hingedly move with respect to the first portion 16 between a first position in which the utensil body 12 is operatively usable by a user, and a second position in which the utensil body 12 is stored within the handle 14. In the closed state, with the utensil body 12 in its second position, the handle may enclose the utensil body 12.

The handle first portion 16 may have a proximal end portion 42, a distal end portion 44, and a length extending from the proximal end portion 42 to the distal end portion 44. The first portion 16 may include a lower wall 46, two lateral sidewalls 48, and a rear portion 50 disposed at the proximal end portion 42 of the first portion 16. The distal end portion 44 of the first portion 16 may define two receiving formations 30 for receiving the lateral protrusions of the utensil body. The proximal end portion 42 of the first portion 16 may define two receiving formations 52 (which receiving formations 52 are mirror images of one another) for receiving lateral protrusions 54 of the second portion (the lateral protrusions 54, one of which is illustrated in FIG. 7, are mirror images of each other). The lateral protrusions 54 may have a size and shape appropriate for enabling the first and second portions 16, 18 to rotate with respect to one another. In some embodiments, as illustrated in FIG. 7, the lateral protrusions 54 may be substantially cylindrical and may be radially symmetric about the second hinge axis B. The receiving formations 52 may have a size and shape appropriate for receiving the lateral protrusions 54 and enabling the lateral protrusions 54 to rotate within the receiving formations 52. In some embodiments, the receiving formations 52 may be substantially circular indentations in the rear portion 50. In some embodiments, as illustrated, the receiving formations 52 may terminate within the wall thickness of the rear portion 50. In other embodiments, the receiving formations 52 extend through the entire wall thickness of the rear portion 50.

In some embodiments, instead of one or more of the receiving formations 52 being defined in the first portion 16 and one or more of the lateral protrusions 54 being provided on the second portion 18, one or more receiving formations may be provided in the second portion 18, and one or more lateral protrusions may be provided on the first portion 16 for movably coupling the first portion 16 with the second portion 18.

The handle first portion 16 may further include a sidewall recess 56 along the length of each lateral sidewall 48 of the first portion. Lateral protrusions 58 may extend from the sidewall recesses 56, which protrusions 58 may be received by receiving formations 60 on the second portion 18 for securing the handle 14 in the closed position.

The handle second portion 18 may have a proximal end portion 62, a distal end portion 64, and a length extending from the proximal end portion 62 to the distal end portion 64. The handle second portion 18 may include an upper wall 66, two lateral sidewalls 68, and a rear portion 70 disposed at the proximal end portion 62 of the second portion 18. The rear portion 70 may include two lateral protrusions 54 (which protrusions may be mirror images of each other across the length of the second portion 18) that may be received by the receiving formations 52 at the proximal end portion 42 of the first portion 16 to create a hinged coupling between the first and second portions 16, 18. The lateral protrusions 54 may define the second hinge axis B. The lateral sidewalls 68 may include upper portions and lower, reduced-thickness portions. The reduced thickness portions may overlap the sidewall recesses 56 of the first portion 16 to create flush outer surfaces of the handle 14 in the closed position of the handle 14. The reduced-thickness portions may further include receiving formations 60 that receive and couple with the lateral protrusions 58 of the first portion sidewall recesses 56, which coupling may secure the handle 14 in the closed position.

The second portion 18 may further include a vertical protrusion 36, disposed on the distal end portion 64 of the second portion 18, that extends downward from the upper wall 66 of the second portion 18. As noted above, the vertical protrusion 36 may be provided on the second portion 18 and may be received by receiving formations 32, 34 defined by the utensil body 12 to secure the handle 14 in the closed position. The vertical protrusion 36, in conjunction with the receiving formations 32, 34 of the utensil body 12, may collectively comprise a latch configured to secure the utensil 10 in the closed position. The vertical protrusion 36 may be secured in the receiving formations 32, 34 by friction fit, in some embodiments.

In some embodiments, instead of the vertical protrusion 36 being provided on the handle 14 (e.g., on the second portion 18) and receiving formations 32, 34 being defined in the utensil body 12, a protrusion may be provided on the utensil body 12, and corresponding receiving formations may be defined in the inner surfaces of the handle 14 for forming a latch that may secure the handle 14 in the closed configuration.

The second portion 18 may further include a finger rest 72 and a latch release 74 on an upper surface of the second portion 18. The finger rest may be in the form of a bump or other protrusion. The latch release 74 may be configured to release the vertical protrusion 36 from the receiving formations 32, 34 of the utensil body responsive to user actuation of the latch release 74. In an embodiment, the latch release 74 may be a horizontal tab on which a user may apply an upward force to pull the vertical protrusion 36 out of a receiving formation 32, 34.

Referring to FIGS. 3, 6, and 7, the handle first portion 16 and handle second portion 18 may collectively define an interior cavity in which the utensil body 12 may be enclosed in the second position of the utensil body 12. The interior cavity may be substantially empty when the utensil body 12 is in the first position. The interior cavity may be bounded by the rear portions 50, 70 of the first and second portions 16, 18, by the upper wall 66 of the second handle portion 18 and lower wall 46 of the first handle portion 16, and by the lateral sidewalls 48, 68 of the first and second portions 16, 18. Except for the utensil body 12 and the vertical protrusion 36, the interior cavity may be unbounded on its distal end. When the utensil body 12 is in its first, operative position, and the handle 14 is in its closed position, the proximal end portion 24 of the utensil body 12 may substantially cover the distal end opening of the interior cavity. Similarly, when the utensil body 12 is in its second, stored position and the handle 14 is in its closed position, the distal end opening of the cavity may be substantially covered by the proximal end portion 24 of the utensil body 12. Accordingly, the handle cavity may be substantially covered or sealed on its distal end by the proximal end portion 24 of the utensil body 12 in the closed position.

The first and second portions 16, 18 of the handle 14 may comprise one or more appropriate materials. For example, the first and second portions 16, 18 may comprise a thermoplastic polymer, such as polypropylene, or another molded plastic, in some embodiments. In some embodiments, the first portion 16 may comprise the same material or materials as the second portion 18. In other embodiments, the first and second portions 16, 18 may include different materials from each other. In some embodiments, the first portion 16 may be made from a single monolithic body of material. Similarly, in some embodiments, the second portion 18 may be made from a single monolithic body of material.

In operation, a user may use the utensil to eat with the utensil body 12 in its first, operative position and the handle 14 in its closed configuration. To store and transport the utensil, the user may open the handle 14 by rotating the first portion 16 with respect to the second portion 18 about the second hinge axis B, to move the handle 14 into its open configuration. With the handle 14 in its open configuration, the user may rotate the utensil body 12 with respect to the first portion 16 from its first, operative position to its second, stored position. In the second, stored position the working element 22 may be stored at the proximal end portion 40 of the handle 14. The user may then rotate the second portion 18 about the second hinge axis B from the open position to the closed position, to arrive at the configuration illustrated in FIG. 4.

FIGS. 8-14 are various views of the utensil, further illustrating the exterior surfaces and contours of the utensil.

While this disclosure has described certain embodiments, it will be understood that the claims are not intended to be limited to these embodiments except as explicitly recited in the claims. On the contrary, the instant disclosure is intended to cover alternatives, modifications and equivalents, which may be included within the spirit and scope of the disclosure. Furthermore, in the detailed description of the present disclosure, numerous specific details are set forth in order to provide a thorough understanding of the disclosed embodiments. However, it will be obvious to one of ordinary skill in the art that systems and methods consistent with this disclosure may be practiced without these specific details.

What is claimed is:

1. A utensil comprising:

a utensil body; and a handle comprising a first portion and a second portion, the first portion hingedly coupled to the utensil body, wherein:

the first portion is coupled to the second portion and moveable with respect to the second portion between an open state and a closed state;

in the open state, the utensil body is permitted to hingedly move with respect to the first portion between a first position in which the utensil body is operatively usable by a user and a second position in which the utensil body is stored within a cavity collectively defined by the first portion and the second portion;

in the closed state, the cavity is configured to enclose the utensil body while the utensil body is in the second position; and the first portion and the second portion further define a distal opening of the cavity, wherein a proximal end portion of the utensil body is in the distal opening.

2. The utensil of claim 1, wherein the first portion comprises a distal end portion and a proximal end portion, wherein the first portion is hingedly coupled to the utensil body at the distal end portion, and the first portion is hingedly coupled to the second portion at the proximal end portion.

3. The utensil of claim 1, wherein the second portion of the handle is configured to latch to the utensil body to secure the second portion of the handle to the utensil body while the first portion and the second portion are in the closed state.

4. The utensil of claim 3, wherein a protrusion on one of the utensil body and the second portion of the handle is configured to latch to a receiving formation on the other of the utensil body and the second portion of the handle.

5. The utensil of claim 4, wherein the receiving formation is a first receiving formation configured to receive the protrusion to secure the handle in the closed state with the utensil body in the first position, wherein a second receiving formation of the utensil body is configured to receive the protrusion to secure the handle in the closed state with the utensil body in the second position.

6. The utensil of claim 5, wherein the first and second receiving formations are defined in opposed sides of the utensil body.

7. The utensil of claim 4, wherein the protrusion is provided on the second portion.

8. The utensil of claim 3, wherein the second portion comprises:

a proximal end attached to the first portion, a distal end opposite the proximal end; and an edge of the second portion at the distal end, wherein the edge of the second portion is configured to receive a user actuation to unlatch the second portion from the utensil body while the second portion is latched to the utensil body.

9. The utensil of claim 8, wherein the edge is configured to receive the user actuation to unlatch the second portion from the utensil body while the utensil body is in either of the first position or the second position.

10. The utensil of claim 1, wherein one of the utensil body or the first portion of the handle comprises a lateral protrusion, and the other of the utensil body or the first portion of the handle comprises a receiving formation that receives the lateral protrusion to hingedly couple the utensil body with the first portion of the handle.

11. The utensil of claim 10, wherein the utensil body comprises:

a neck having a proximal end and a distal end;

the lateral protrusion, protruding from the proximal end of the neck; and a working element disposed at the distal end of the neck;

wherein the neck, the lateral protrusion, and the working element comprise a monolithic body of material.

12. The utensil of claim 1, wherein the utensil body is configured to rotate with respect to the first portion of the handle about a first hinge axis and the second portion of the handle is configured to rotate with respect to the first portion of the handle about a second hinge axis, wherein the first hinge axis is substantially parallel with the second hinge axis.

13. The utensil of claim 1, wherein the utensil body is configured to rotate with respect to the first portion of the handle about a first hinge axis, the first hinge axis substantially perpendicular to a direction of extension of the utensil body from the handle in the first position.

14. The utensil of claim 1, wherein the utensil body comprises a spoon or a fork.

15. The utensil of claim 1, wherein the first portion is hingedly coupled with the second portion, wherein one of the first portion or the second portion of the handle comprises a lateral protrusion, and the other of the first portion or the second portion comprises a receiving formation that receives the lateral protrusion to hingedly couple the first portion with the second portion.

16. The utensil of claim 1, wherein the proximal end portion of the utensil body is in the distal opening while the utensil body is in the first position and when the utensil body is in the second position.

17. The utensil of claim 1, wherein in the closed state, the first portion and the second portion are configured to secure the proximal end portion of the utensil body within the distal opening while the utensil body is in the first position.

18. The utensil of claim 1, wherein the first portion moves with respect to the second portion about a pivot axis, and further wherein the pivot axis is within the cavity.

19. A utensil comprising:

a utensil body; and a handle comprising a first portion and a second portion, the first portion hingedly coupled to the utensil body, wherein:

the first portion is coupled to the second portion and moveable with respect to the second portion between an open state and a closed state;

in the open state, the utensil body is permitted to hingedly move with respect to the first portion between a first position in which the utensil body is operatively usable by a user and a second position in which the utensil body is stored within a cavity collectively defined by the first portion and the second portion;

in the closed state, the cavity is configured to enclose the utensil body while the utensil body is in the second position; and the second portion of the handle is configured to latch to the utensil body to secure the second portion of the handle to the utensil body while the first portion and the second portion are in the closed state, wherein the second portion comprises:

a proximal end attached to the first portion, a distal end opposite the proximal end; and an edge of the second portion at the distal end, wherein the edge of the second portion is configured to receive a user actuation to unlatch the second portion from the utensil body while the second portion is latched to the utensil body.

20. The utensil of claim 19, wherein the first portion and the second portion further define a distal opening of the cavity, and further wherein a proximal end portion of the utensil body is in the distal opening.

* * * * *